US007486162B2

(12) United States Patent
Weitzenberger et al.

(10) Patent No.: US 7,486,162 B2
(45) Date of Patent: Feb. 3, 2009

(54) HIGH FREQUENCY FILTER

(75) Inventors: Wilhelm Weitzenberger, Simbach/Inn (DE); Franz Rottmoser, Schechen (DE)

(73) Assignee: Kathrein-Werke KG, Rosenheim (DE)

( * ) Notice: Subject to any disclaimer, the term of this patent is extended or adjusted under 35 U.S.C. 154(b) by 206 days.

(21) Appl. No.: 10/591,637

(22) PCT Filed: Mar. 3, 2005

(86) PCT No.: PCT/EP2005/002248

§ 371 (c)(1),
(2), (4) Date: Sep. 5, 2006

(87) PCT Pub. No.: WO2005/086275

PCT Pub. Date: Sep. 15, 2005

(65) Prior Publication Data

US 2007/0194865 A1 Aug. 23, 2007

(30) Foreign Application Priority Data

Mar. 4, 2004 (DE) ..... 10 2004 010 683

(51) Int. Cl.
*H01P 3/06* (2006.01)

(52) U.S. Cl. ..... 333/206; 333/202

(58) Field of Classification Search ..... 333/202–207
See application file for complete search history.

(56) References Cited

U.S. PATENT DOCUMENTS 6,437,664 B1 * 8/2002 Meppelink et al. ..... 333/182
6,452,465 B1 * 9/2002 Brown et al. ..... 333/205
2006/0255888 A1 * 11/2006 Mayr ..... 333/223

FOREIGN PATENT DOCUMENTS

EP 1 169 747 B1 4/2000
EP 1 202 375 A 5/2002

OTHER PUBLICATIONS

International Search Report of PCT/EP2005/002248, mailed Jun. 16, 2005.
Patent Abstracts of Japan, vol. 11, No. 343, Nov. 10, 1987, for JP 62 123801, published Jun. 5, 1987.
Patent Abstracts of Japan, vol. 17, No. 178, Apr. 7, 1993, for JP 04 332202 A, published Nov. 19, 1992.

(Continued)

*Primary Examiner*—Don P Le
(74) *Attorney, Agent, or Firm*—Nixon & Vanderhye PC

(57) ABSTRACT

An improved high frequency filter of coaxial construction comprises one or more resonators having an electrically conductive internal conductor configured as an internal conductive tube and an electrically conductive external conductor. An electrically conductive base electrically interconnects the internal conductor and the external conductor. A cover covers the high frequency filter with respect to the base; and an inner side and outer side. The inner side points toward a free end of the internal conductive tube. A dielectric layer having a dielectric constant $E_r$ greater than 2 is arranged between the outer side of the cover and the free end of the internal conductive tube. The radial extent of the dielectric layer substantially covers the cross section of the internal conductive tube at the free end thereof.

19 Claims, 4 Drawing Sheets

OTHER PUBLICATIONS

Wang et al., "Modeling of Re-Entrant Coaxial and Combline Resonators and Filters", IEEE Antennas and Propagation Society International Symposium 1996 Digest, vol. 1, Jul. 21, 1996, pp. 280-283, XP000782160.

Wu et al., Institute of Electrical and Electronics Engineers, "A full Wave Analysis of a Conductor Post Insert Reentrant Coaxial Resonator in Rectangular Waveguide Combine Filters", 1996 IEEE MTT-S International Microwave Symposium Digest, vol. 3, Jun. 17, 1996, pp. 1639-1642, XP000720658.

Hunter, IEE Electromagnetic Waves Series 48, Abschnitt 5.8, "Theory and Design of Microwave Filters".

* cited by examiner

HIGH FREQUENCY FILTER

This application is the U.S. national phase of international application PCT/EP2005/002248, filed 3 Mar. 2005, which designated the U.S. and claims priority from DE 10 2004 010 683.5, filed 4 Mar. 2004, the entire contents of each of which are hereby incorporated by reference.

The invention relates to a high frequency filter of coaxial construction, in particular in the manner of a high frequency switch (such as, for example, a duplex switch) or a band-pass filter or band-stop filter.

In radio technological systems, in particular in the field of mobile communications, a common antenna is often used for transmission and reception signals. The transmission and reception signals use respectively different frequency ranges, and the antenna must be suitable for transmitting and receiving in both frequency ranges. A suitable frequency filtering means, with which, on the one hand, the transmission signals are forwarded from the transmitter to the antenna and, on the other hand, the reception signals are forwarded from the antenna to the receiver, is therefore required for separating the transmission and reception signals. High frequency filters of coaxial. construction are nowadays used, among other means, for splitting up the transmission and reception signals.

A pair of high frequency filters, which both allow through a specific frequency band (band-pass filter), may, for example, be used. Alternatively, a pair of high frequency filters, which both block a specific frequency band (band-stop filter), may be used. In addition, a pair of high frequency filters may be used, of which one filter allows through frequencies below a frequency between the transmission and reception bands and blocks frequencies above this frequency (low-pass filter), and the other filter blocks frequencies below a frequency between the transmission and reception bands and allows through frequencies thereabove (high-pass filter). Further combinations of the aforementioned types of filter are also conceivable.

High frequency filters are often constructed from coaxial resonators, as these consist of milled and cast parts, as a result of which they are easy to produce. Furthermore, these resonators ensure high electrical quality and a relatively high degree of temperature stability.

Document EP 1 169 747 B1 describes an example of a generic coaxial high frequency filter. This filter comprises a resonator with a cylindrical internal conductor and a cylindrical external conductor, a capacitance, which influences the resonance frequency, being formed between a free end of the internal conductor and a cover fastened to the external conductor. The resonator further comprises a tuning element made from a dielectric material and with which the resonance frequency of the filter may be adjusted. The tuning element is movable in the internal conductor of the resonator, as a result of which the capacitance between the free end of the internal conductor and the cover of the resonator is altered and the resonance frequency is thus varied.

The publication "Theory and Design of Microwave Filters", Ian Hunter, IEE Electromagnetic Waves Series 48, Section 5.8, discloses coaxial resonator filters with a large number of individual resonators which are coupled to one another.

In the high frequency filters known from the prior art, it has been found to be disadvantageous that filters having low resonance frequencies lead to a large overall volume, and this in turn increases the material and machining costs. The large overall volume results from the fact that a low resonance frequency is achieved by a long internal conductor. Although the resonance frequency may also be reduced by reducing the distance from the filter cover to the free end of the internal conductor, this has the undesirable effect that the dielectric strength of the resonator is reduced. If the distances between the free end of the internal conductor and the cover are too small, the voltage applied at this location soon results in breakdowns via the layer of air between the cover and the free end of the internal conductor, and this affects the transmission of signals and may destroy the filter.

The object of the present invention is, therefore, to provide a high frequency filter of coaxial construction which has both high dielectric strength and a low overall volume.

This object is achieved by the independent claims. Developments of the invention are defined in the dependent claims.

The high frequency filter according to the invention comprises an electrically conductive internal conductor configured as an internal conductive tube, an electrically conductive external conductor and an electrically conductive base which electrically interconnects the internal conductor and the external conductor. Also provided is a cover covering the high frequency filter with respect to the base. The cover has an inner side and outer side, the inner side pointing toward a free end of the internal conductive tube. In the high frequency filter, a dielectric layer having a relative dielectric constant greater than 2 is arranged between the outer side of the cover and the free end of the internal conductive tube. The radial extent of the dielectric layer substantially covers the cross section of the internal conductive tube at the free end thereof. As a result of a dielectric layer of this type, an increase in capacitance, and therefore a reduction of the resonance frequency, is achieved, owing to the high dielectric constant, without increasing the overall volume. Moreover, as the dielectric layer substantially covers the entire cross section of the internal conductive tube, the dielectric strength between the internal conductive tube and cover is improved.

In a particularly preferred embodiment, a high dielectric material having a relative dielectric constant greater than or equal to 5, preferably greater than or equal to 8, particularly preferably greater than or equal to 9, is used as the dielectric layer. Materials having a much higher dielectric constant, for example materials having a relative dielectric constant greater than or equal to 40, may also be used. For example, the constant may be between 40 and 80 or between 60 and 80. As materials having a high dielectric constant, ceramic materials, for example, in particular aluminum oxide ceramic, are used for the dielectric layer.

Preferably, the surface area of the radial extent of the dielectric layer is at least twice the surface area of the cross section of the internal conductive tube at the free end thereof. This provides extensive coverage of the internal conductive tube with dielectric material, thus ensuring a very high dielectric strength.

In a further embodiment, the cross section of the internal conductive tube is substantially circular at the free end thereof. The radial extent of the dielectric layer may also be substantially circular. If both the cross section of the internal conductive tube at the free end thereof and the radial extent of the dielectric layer are circular, the diameter of the radial extent is, in a preferred variation of the invention, at least as great as the diameter of the cross section. Preferably, the diameter of the radial extent is at least 1.5 times the diameter of the cross section. Moreover, the external conductor may also have a substantially circular cross section, the diameter of which is preferably at least twice the diameter of the radial extent of the dielectric layer.

In a particularly preferred variation of the invention, the dielectric layer is arranged on the cover of the high frequency filter, in particular is fastened to the cover. The dielectric layer may, for example, be inserted in a recess in the inner side of the cover.

The dielectric layer may be held in the recess by an interlocking fit, in particular by an edge, projecting beyond the edge of the dielectric layer, on the inner side of the cover. Alternatively or additionally to the interlocking fit, the dielectric layer may be held on the inner side of the cover by an adhesion means, in particular adhesive. In a further variation of the invention, the dielectric layer is closed by the inner side of the cover.

In a further embodiment, the high frequency filter comprises a plurality of resonators, a single continuous, at least partially strip-like dielectric layer being provided for all of the resonators.

The high frequency filter according to the invention is preferably configured in such a way that as a result of the configuration and coupling of the resonators, a duplex switch is formed. A configuration as a band-pass filter or band-stop filter is, however, also conceivable.

Embodiments of the invention will be described hereinafter with reference to the accompanying drawings, in which.

Figure 1:
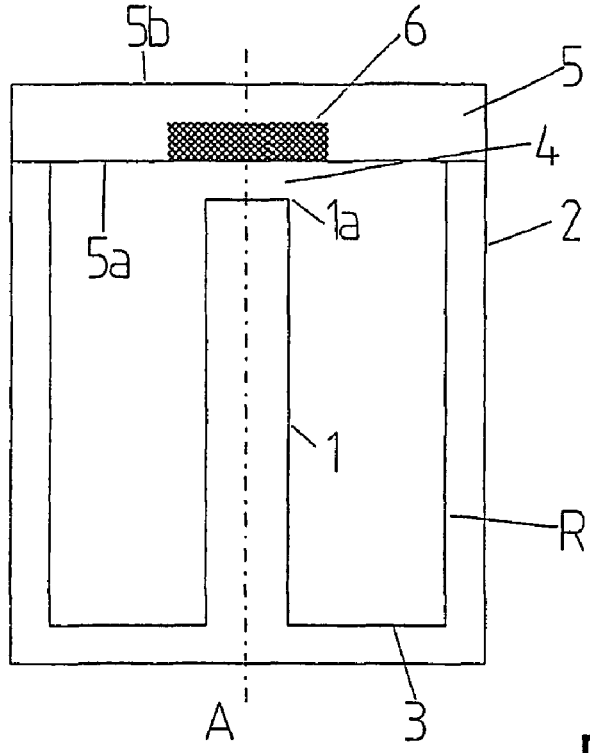
FIG. 1 is a side view of an embodiment of a resonator used in the high frequency filter according to the invention.

FIG. 1 is the side view of a resonator for use in a high frequency filter according to the invention. It is a resonator of coaxial construction extending along the axis A. The resonator comprises an electrically conductive cylindrical internal conductive tube 1, the lower end 1*b* of which is inserted in a base 3. The base 3 is also cylindrical in its configuration and connected at its outer edge to a cylindrical external conductive tube 2. An electrically conductive connection between the external conductive tube 2 and internal conductive tube 1 is produced via the base 3. A cover 5, having the inner side 5*a* and the outer side 5*b*, is located on the external conductive tube. A dielectric 6 (shown in black) is inserted in a recess on the inner side 5*a*. The dielectric opposes a free end 1*a* of the internal conductive tube 1. The distance 4 between the cover 5 and the free end 1*a* of the internal conductive tube 1 is conventionally from 3 to 4 mm and may be reduced to as little as 0.5 mm. In FIG. 1, the dielectric layer is closed by the inner side of the cover. It is also possible for the dielectric layer to protrude from the inner side of the cover or the inner side of the cover to project beyond the dielectric layer.

In the resonator of FIG. 1, a voltage superelevation is produced in the event of resonance at the free end 1*a*, the amount of the voltage being proportional to the power of the signal acting on the resonator. The upper side of the free end of the internal conductive tube 1 and the inner side 5*a* of the cover form a plate capacitor, the capacitance $C_{roof}$ of which is directly proportional to the relative dielectric constant $\in_r$ of the material between the capacitor. In the resonator of FIG. 1, high dielectric material 6 having a relative dielectric constant $\in_r$ which is significantly greater than that of air is used. Preferably, the relative dielectric constant has values of greater than 40. This means that the capacitance $C_{roof}$—in contrast to conventional resonators—is very high. The capacitance $C_{roof}$ is a parallel capacitance to that of the actual resonator and is related to the resonance frequency of the resonator as follows:

$$f=1/2\pi\sqrt{L\cdot(C+C_{roof})}$$

f is the resonance frequency of the resonator, L the inductance of the resonator, C the capacitance of the resonator and $C_{roof}$ the described parallel capacitance to the upper side of the resonator.

The foregoing formula reveals that the higher $C_{roof}$ is, the lower the resonance frequency. The dielectric 6 of the resonator of FIG. 1 therefore provides a resonator having a low resonance frequency. According to the prior art, resonators having low resonance frequencies were achieved not by using a dielectric, but rather by reducing the distance between the cover and the free end of the internal conductive tube. However, limits are set for the reduction of this distance, as this greatly reduces the dielectric strength of the resonator. In order to avoid this problem, resonators according to the prior art use alternately wider internal conductive tubes, as a result of which the resonance frequency is also reduced. However, this leads to an increased resonator volume and therefore to. higher material and machining costs. In contrast thereto, the resonator of FIG. 1 allows a low resonance frequency, a high dielectric strength and a low overall volume to be achieved.

Figure 2:
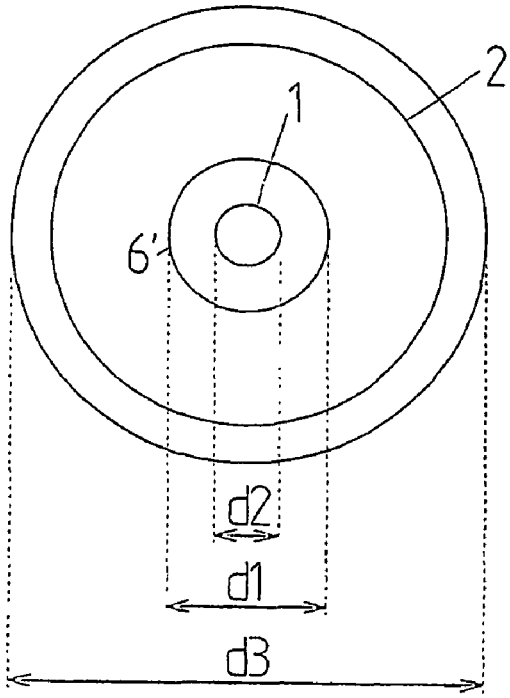
FIG. 2 is a plan view of the resonator of FIG. 1.

FIG. 2 is a plan view of the resonator of FIG. 1. In this case, it is particularly apparent that the internal conductive tube 1 and the external conductive tube 2 are cylindrical in their configuration. The radial extent of the dielectric layer 6, the circular edge of which is denoted in FIG. 2 by 6', is also obtained. In order to provide high dielectric strength even at small distances between the free end 1*a* of the internal conductive tube and the cover 5, the diameter $d_1$ of the dielectric layer is greater than the diameter $d_2$ of the cross section of the internal conductive tube. The diameter $d_1$ is preferably 1.5 times the diameter $d_2$. The diameter $d_3$ of the external conductive tube is substantially greater than the diameters $d_1$ and $d_2$. In a preferred variation, the diameter $d_3$ is twice as great as the diameter $d_1$.

Figure 3:
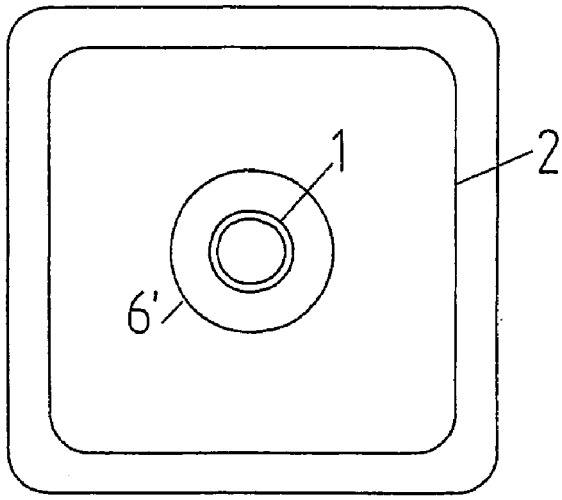
FIG. 3 is a plan view of a modification of the resonator of FIG. 2.

FIG. 3 is a plan view of a modification of the resonator of FIG. 2. In the resonator of FIG. 3, the external conductor 2 is not cylindrical, but rather substantially square with rounded corners. The shape of the internal conductor 1 and the dielectric layer 6 is also cylindrical or circular. However, it is also conceivable for the internal conductive tube or the dielectric layer to have other shapes; in particular, they may also be square in their configuration. Care must merely be taken to ensure that the size of the radial extent of the dielectric layer corresponds at least to the sectional surface area of the internal conductive tube.

Figure 4:
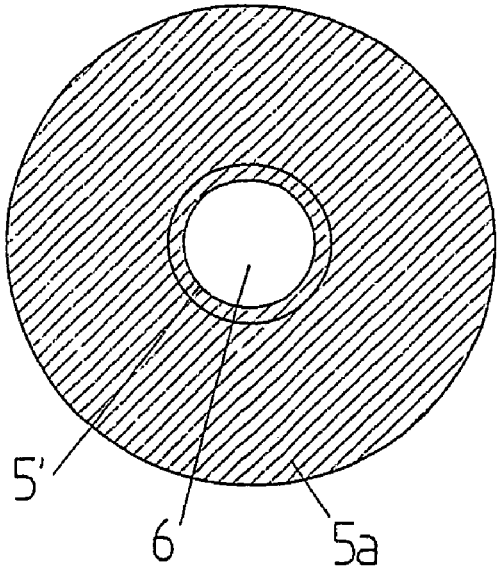
FIG. 4 is a plan view of the inner side of the resonator cover according to an embodiment of the invention.

FIG. 4 is a plan view of a possible configuration of the inner side 5*a* of the cover 5 from FIG. 1. For the sake of clarity, the inner side of the cover is shown hatched. It may be seen that an inner edge 5' of the cover projects beyond the dielectric layer 6. This ensures, by means of an interlocking fit, that the dielectric layer is held in the recess in the cover 5. However, a large number of other holding mechanisms are also possible for holding the dielectric layer 6 in the cover 5. For example, the dielectric layer 6 may be glued in place in the recess.

Figure 5:
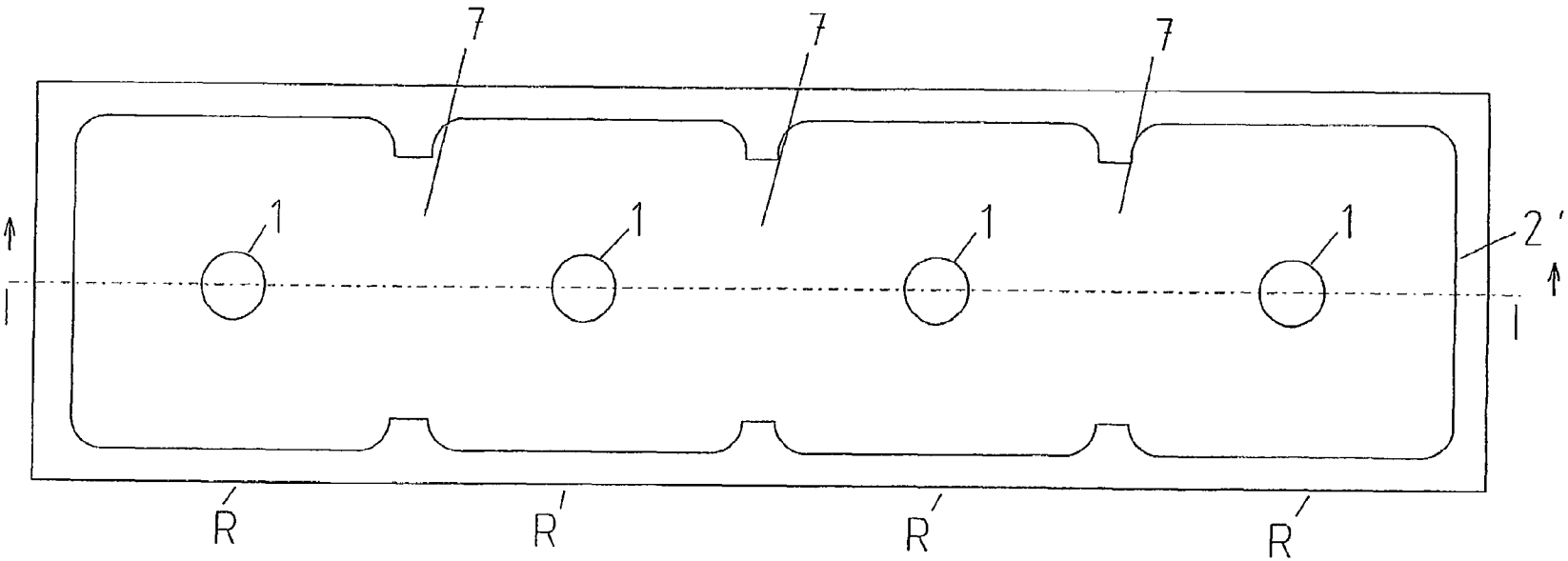
FIG. 5 is a plan view of a band-pass filter in which a plurality of resonators as illustrated in FIG. 3 is used.

FIG. 5 is the plan view of a band-pass filter in which four of the resonators of FIG. 3 are used, the cover of the resonators not being shown. The external conductors of the individual resonators are interconnected via apertures 7, thus forming an overall encircling housing 2'. Coupling of the resonators is achieved through the apertures, in order to generate the desired response of the band-pass filter. The extent of the coupling is determined by the distance between the resonators and by the size of the aperture. In this case, the center frequency of the band-pass filter is proportional to the length of the internal conductive tube 1.

Figure 6:
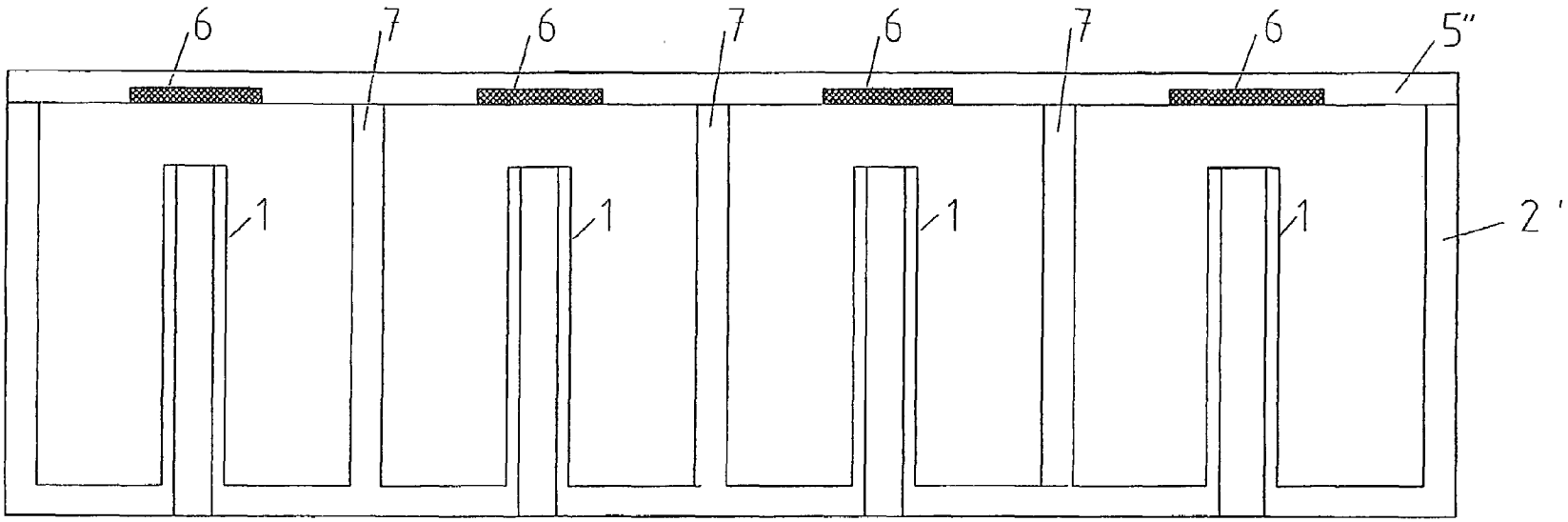
FIG. 6 is a sectional view along the line I-I of the band-pass filter of FIG. 5.

FIG. 6 is a sectional view of the band-pass filter as illustrated in FIG. 5 along the line I-I, the cover of the band-pass filter being attached to the upper side. It may be seen that a continuous cover 5" rests on the upper side of the housing 2'. As in FIG. 1, a dielectric layer 6, as a result of which the dielectric strength and the overall size of the band-pass filter are reduced, is, again, provided opposing the free end 1*a* of the respective internal conductor 1. Alternatively, a single continuous dielectric layer, in the form of a strip, may be provided, the strip extending in the longitudinal direction of the housing 2' and having a width such that each internal conductive tube is covered by the strip.

The invention claimed is:

1. A high frequency filter of coaxial construction, including at least one resonator comprising:

an electrically conductive internal conductor configured as an internal conductive tube;

an electrically conductive external conductors;

an electrically conductive base which electrically interconnects the internal conductor and the external conductors;

a cover covering at least the high frequency filter with respect to the base and having an inner side and outer side, the inner side pointing toward a free end of the internal conductive tube;

a dielectric layer having a relative dielectric constant greater than 2 arranged between the outer side of the cover and the free end of the internal conductive tube;

the radial extent of the dielectric layer substantially covering the cross section of the internal conductive tube at the free end thereof;

wherein the dielectric layer is arranged on or fastened to the cover, and wherein the dielectric layer is inserted in a recess in the inner side of the cover.

2. The high frequency filter as claimed in claim 1, wherein the dielectric layer is held in the recess by an interlocking fit, by an edge, projecting beyond the edge of the dielectric layer, on the inner side of the cover.

3. The high frequency filter as claimed in claim 1, wherein the dielectric layer is closed by the inner side of the cover.

4. The high frequency filter as claimed in claim 1, wherein the dielectric layer is held on the inner side of the cover by an adhesion means.

5. The high frequency filter as claimed in claim 1, wherein the relative dielectric constant of the dielectric layer is $\geqq 5$.

6. The high frequency filter as claimed in claim 1, wherein the relative dielectric constant of the dielectric layer is $\geqq 40$.

7. The high frequency filter as claimed in claim 1, wherein the dielectric layer comprises ceramic material.

8. The high frequency filter as claimed in claim 1, wherein the surface area of the radial extent of the dielectric layer is at least twice the surface area of the cross section of the internal conductive tube at the free end thereof.

9. The high frequency filter as claimed in claim 1, wherein the cross section of the internal conductive tube is substantially circular at the free end thereof.

10. The high frequency filter as claimed in claim 1, wherein the radial extent of the dielectric layer is substantially circular.

11. The high frequency filter as claimed in claim 9, wherein the diameter of the radial extent of the dielectric layer corresponds at least to the diameter of the cross section of the internal conductive tube at the free end thereof.

12. The high frequency filter as claimed in claim 11, wherein the diameter of the radial extent of the dielectric layer is at least 1.5 times the diameter of the cross section of the internal conductive tube at the free end thereof.

13. The high frequency filter as claimed in claim 10, wherein the external conductor is an external conductive tube having a substantially circular cross section and the diameter of the external conductive tube is at least twice the diameter of the radial extent of the dielectric layer.

14. The high frequency filter as claimed in claim 1, wherein the high frequency filter comprises a plurality of resonators, a single continuous, at least partially strip-like dielectric layer being provided for all of the resonators.

15. The high frequency filter as claimed in claim 1, wherein the resonators are configured and coupled in such a way that a duplex switch is formed.

16. The high frequency filter as claimed in claim 1, wherein the resonators are configured and coupled in such a way as to provide band filter.

17. The filter of claim 5 wherein the dielectric constant is $\geqq 9$.

18. The filter of claim 6 wherein the dielectric constant is between 60 and 80.

19. The filter of claim 16 wherein the band filter comprises a band pass filter.

* * * * *